US005494776A

United States Patent [19]

Cotner

[11] Patent Number: 5,494,776

[45] Date of Patent: Feb. 27, 1996

[54] HYBRID GRAPHIC ARTS FILMS WITH REDUCED OCCURRENCE OF PEPPER FOG

[75] Inventor: Richard C. Cotner, Stillwater, Minn.

[73] Assignee: Minnesota Mining and Manufacturing Company, St. Paul, Minn.

[21] Appl. No.: 248,369

[22] Filed: May 24, 1994

[51] Int. Cl.[6] ..... G03C 1/06

[52] U.S. Cl. ..... 430/267; 430/264

[58] Field of Search ..... 430/264, 267, 430/551, 613, 614, 615

[56] References Cited

U.S. PATENT DOCUMENTS

| | | | |
|---|---|---|---|
| 2,857,276 | 10/1958 | Land et al. | 430/250 |
| 4,237,214 | 12/1980 | Mifune et al. | 430/441 |
| 4,241,164 | 12/1980 | Mifune et al. | 430/264 |
| 4,269,929 | 5/1981 | Nothnagle | 430/264 |
| 4,341,858 | 7/1982 | Chaffee et al. | 430/223 |
| 4,619,886 | 10/1986 | Okutsu | 430/265 |
| 4,668,605 | 5/1987 | Okutsu et al. | 430/267 |
| 4,693,956 | 9/1987 | Marchesano | 430/264 |
| 4,740,452 | 4/1988 | Okutsu et al. | 430/439 |
| 4,798,780 | 1/1989 | Hall et al. | 430/264 |
| 4,914,003 | 4/1990 | Yagihara | 430/264 |
| 4,937,160 | 6/1990 | Ruger | 430/264 |
| 4,956,260 | 9/1990 | Nakamura | 430/138 |
| 4,975,354 | 12/1990 | Machonkin et al. | 430/264 |
| 5,128,233 | 7/1992 | Beisswenger et al. | 430/528 |
| 5,139,921 | 8/1992 | Takagi et al. | 430/264 |

FOREIGN PATENT DOCUMENTS

| | | | |
|---|---|---|---|
| 0324391 | 1/1989 | European Pat. Off. . | |
| 0420005 | 9/1990 | European Pat. Off. . | |
| 0539925 | 10/1992 | European Pat. Off. . | |
| 2173894 | 12/1973 | France . | |
| 60-140340 | 7/1985 | Japan . | |
| 1178962 | 7/1989 | Japan | 430/614 |
| 4136844 | 5/1992 | Japan | 430/615 |
| 1581963 | 4/1978 | United Kingdom . | |

*Primary Examiner*—Lee C. Wright

*Attorney, Agent, or Firm*—Gary L. Griswold; Walter N. Kirn; Susan Moeller Zerull

[57] ABSTRACT

The present invention provides a photographic element developed in the presence of a hydrazide which displays high contrast but low levels of pepper fog. The novel silver halide photographic elements comprise, in at least one layer of the element, a pepper reducing agent. The pepper reducing agent of this invention is a compound having at least one nitrogen containing, heterocyclic ring group and at least one carbonyl group in or attached to said ring. The pepper reducing agents preferably are selected from the group containing 2,5-piperazinediones; glycol urils; 2,3-pyrazinedicarboxamides; 3-iminoisoindolinones; or glutarimides.

13 Claims, No Drawings

HYBRID GRAPHIC ARTS FILMS WITH REDUCED OCCURRENCE OF PEPPER FOG

FIELD OF THE INVENTION

This invention relates to black and white photographic elements, particularly to negative acting graphic art films, and more particularly to negative acting hybrid (high contrast, hydrazine activated) graphic arts films. Specifically this invention relates to negative acting hybrid graphic art films incorporating compounds to reduce pepper.

BACKGROUND OF THE INVENTION

High contrast negatives for line and half-tone work are important in the practice of the graphic arts. Development of such films is carried out for maximum contrast in special developers which are known in the art as 'lith' developers. In conventional lith developers, high contrast is achieved using the lithographic effect, (also referred to as infectious development) as described by Yule in the *Journal of the Franklin Institute,* 239, 221–230. This type of development is believed to proceed autocatalytically. To achieve the lith effect in development, a low, but critical concentration of free sulfite ion is maintained by using an aldehyde bisulfite adduct, such as sodium formaldehyde bisulfite, which acts as a sulfite ion buffer. The low sulfite ion concentration is necessary to avoid interference with the accumulation of developing agent oxidation products. Such interference can result in cessation of infectious development. The developer typically contains only a single type of developing agent, namely, a developing agent of the dihydroxybenzene type, such as hydroquinone, but auxiliary developers are known in the art.

Conventional lith developers suffer from serious deficiencies which restrict their usefulness. For example, the developers tend to exhibit low capacity as a result of the fact that it contains hydroquinone as the sole developing agent. Also, the aldehyde tends to react with the hydroquinone to cause undesirable changes in development activity. Furthermore, the low sulfite ion concentration is inadequate to provide effective protection against aerial oxidation. As a result, conventional lith developers lack stability and tend to give erratic results depending on the length of time that they have been exposed to the air.

An alternative to the use of conventional lith developers is disclosed in Nothnagle, U.S. Pat. No. 4,269,929, 'High Contrast Development Of Photographic Elements'. As described in this patent, high contrast development of photographic elements is carried out in the presence of a hydrazine compound with an aqueous alkaline developing solution which has a pH of about 10 and below 12 and contains a dihydroxybenzene developing agent, a 3-pyrazolidone developing agent, a sulfite preservative, and as a contrast-promoting agent, an amino compound. U.S. Pat. No. 4,269,929 describes the use of a very wide variety of amino compounds as contrast-promoting agents. In particular, it discloses the use of both inorganic amines, such as the hydroxylamines, and organic amines, including aliphatic amines, alkyl amines, alkanol amines, aromatic amines, cyclic amines, mixed aliphatic-aromatic amines, and heterocyclic amines. Primary, secondary and tertiary amines, as well as quaternary ammonium compounds, are included within the broad scope of the disclosure.

High contrast developing compositions which contain amino compounds as contrast-promoting agents which are intended for carrying out development in the presence of a hydrazine compound are also disclosed in U.S. Pat. Nos. 4,668,605 and 4,740,452. U.S. Pat. No. 4,668,605 describes developing compositions containing a dihydroxybenzene, a p-aminophenol, a sulfite, a contrast-promoting amount of an alkanolamine comprising an hydroxyalkyl group of 2 to 10 carbon atoms, and a mercapto compound. The developing compositions of U.S. Pat. No. 4,740,452 contain a contrast-promoting amount of certain trialkyl amines, monoalkyldialkanol amines or dialkylmonoalkanol amines.

The inherent disadvantages of incorporating amino compounds as contrast-promoting agents in developing compositions have been recognized in the prior art, and proposals have been made heretofore to overcome these disadvantages and other problems by incorporating the amino compound in the photographic element. In particular, the use of amino compounds as incorporated boosters, has been proposed in Japanese Patent Publication Nos. 140340/85 and 222241/87. In Publication No. 140340/85, it is alleged that any amino compound can be utilized as an 'incorporated booster,' while Publication No. 222241/87 is directed to the use of amino compounds defined by a specific structural formula as incorporated boosters. Publication No. 222241/87 points to some of the problems involved in following the teachings of Publication No. 140340/85, including generation of 'pepper fog'. Pepper fog may be described as black dots appearing on the developed film which do not correspond to the exposed image. The effect can appear as though pepper has been spilled on the film, hence the name.

A photographic system depending on the joint action of hydrazine compounds which function as nucleators, and amino compounds which function as contrast-promoting agents is an exceedingly complex system. It is influenced by both the composition and concentration of the nucleator and contrast-promoting agent and by many other factors including the pH and composition of the developer and the time and temperature of development. The goals of such a system include the provision of enhanced contrast, together with excellent dot quality and low pepper fog.

U.S. Pat. No. 4,237,214, Mifune et al., describes a lith system utilizing heterocyclic quaternary salts in addition to arylacylhydrazine.

British Patent 1,581,963, assigned to Fuji, claims increased speed and contrast when thioamide compounds, such as benzothiazolinethione, are present in addition to the hydrazide.

U.S. Pat. No. 4,241,164, Mifune et al., claims increased sensitivity when the emulsion contains hydroxytetraazaindene.

U.S. Pat. No. 4,937,160 discloses use of hydrazides with amino boosters.

U.S. Pat. No. 4,914,003, Yagihara et al., describes a system using a hydrazine and a amine compound of general formula:

$$\begin{array}{l} R^2 \\ | \\ N-A-(X)_n-R^1 \end{array}$$

U.S. Pat. No. 4,975,354, Machonkin et al., describes a system using a hydrazine and certain secondary and tertiary amino compounds of general formula:

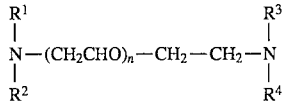

EP 0,324,391, Takamuki, describes a high contrast silver halide emulsion containing 3-pyrazolidone and di- or trihydroxybenzene compound which is developed in a developer containing a di- or trihydroxybenzene compound, sulfite, and an amino compound in the presence of a hydrazide.

U.S. Pat. No. 5,139,921, Takagi, describes a process of forming a high contrast image with a silver halide material containing a hydrazide and a nucleation accelerator (an amino containing mercaptan, mercaptotetrazole, oxazole, oxadiazole, triazole, imidazole, thiadiazole, diazole, triazolopyrimide, or purines) in a developer of pH 9.6 to 11.0.

U.S. Pat. No. 4,956,260, Nakamura, describes a photothermographic system using five or six membered nitrogen containing heterocyclic compounds as an antifoggant or development accelerator.

European Patent 0420005, Takahiro, describes an ultra-high contrast silver halide material containing a hydrazide nucleating agent and a development inhibiter.

European Patent 0539925, Onodera, describes a high contrast silver halide material containing substituted phenyl hydrazines.

U.S. Pat. No. 4,693,956, Marchesano, describes a process for forming a high contrast image comprising a silver halide material containing a hydrazine, antifoggant, and contrast promoting agent within the classes of benzotriazole and benzimidazole compounds.

U.S. Pat. No. 2,857,276, Land et al., describes a diffusion transfer-reversal photographic process wherein an aqueous solution containing cyclic imides are used to form water soluble complex silver salts.

SUMMARY OF THE INVENTION

The present invention provides a photographic element developed in the presence of a hydrazide which displays high contrast but low levels of pepper fog. The novel silver halide photographic elements comprise, in at least one layer of the element, a pepper reducing agent. The pepper reducing agent of this invention is a compound having at least one nitrogen containing, heterocyclic ring group and at least one carbonyl group in or attached to said ring. The pepper reducing agents preferably are selected from the group containing 2,5-piperazinediones; glycol urils; 2,3-pyrazinedicarboxamides; 3-iminoisoindolinones; or glutarimides.

DETAILED DESCRIPTION OF THE INVENTION

This invention provides novel silver halide photographic elements which contain, in at least one layer of the element, a pepper reducing agent. These elements are developed in the presence of a hydrazine compound. The hydrazine compound is preferably incorporated in one or more layers of the photographic element.

The pepper reducing agents of this invention have at least one nitrogen containing, heterocyclic ring group and at least one carbonyl group attached to said ring. The pepper reducing agents are selected from compounds having the following general formulas:

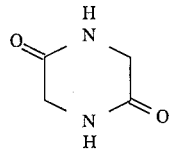

Compound 1: 2,5-piperazinedione

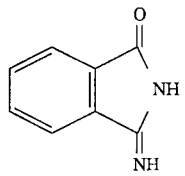

Compound 2: 3-iminoisoindolinone

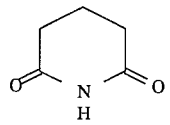

Compound 3: glutarimide

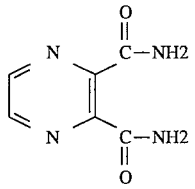

Compound 4: 2,3-pyrazinedicarboxamide

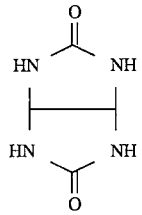

Compound 5: glycol uril

In the photographic and graphics art field, substitution of compounds is common and often desirable. As long as the substitution does not alter fundamental aspects of the structure (e.g., converting a divalent bond to a single bond), any compound containing the defined general formula is contemplated by the inventors as performing in its capacity within the scope of the present invention.

Suitable substitutions to 2,5-piperazinedione may include

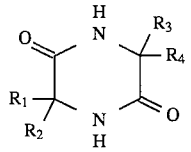

wherein $R_1$, $R_2$, $R_3$ and $R_4$ are independently hydrogen, alkyl, alkanol, carboxy alkyl or alkyl sulfonic acid groups.

Suitable substitutions to glycol uril, for example may be

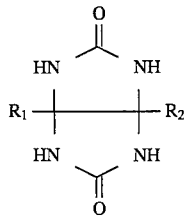

wherein $R_1$ and $R_2$ are independently hydrogen, alkyl, alkanol, carboxy alkyl, or alkyl sulfonic acid groups.

Suitable substitutions to 3-iminoisoindolinone may include

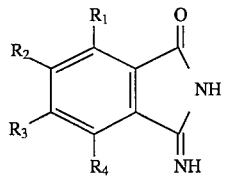

wherein, $R_1$, $R_2$, $R_3$, and $R_4$ independently are hydrogen, alkyl or cyclic alkyl groups or any pair of $R_1$ and $R_2$, $R_2$ and $R_3$, or $R_3$ and $R_4$ taken together form an aromatic ring.

The following structure is an example of suitable substitutions on glutarimide compounds:

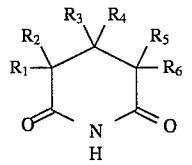

wherein, $R_1$, $R_2$, $R_3$, $R_4$, $R_5$, and $R_6$ are independently hydrogen, alkyl, alkanol, carboxy alkyl, or alkyl sulfonic acid groups.

An example of suitable substitutions to a 2,3-pyrazinedicarboxamide includes

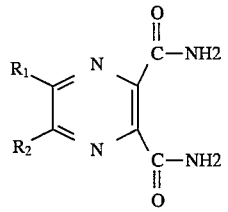

wherein, $R_1$ and $R_2$ independently are hydrogen, alkyl, or cyclic alkyl groups or $R_1$ and $R_2$ taken together form an aromatic ring.

Although the pepper reducing agents may be utilized with a variety of silver halide emulsions, a preferred silver halide photographic light sensitive emulsion comprises a hydrophilic colloid binder, negative-acting silver halide grains, a hydrazine, and a pepper reducing agent. One preferred silver halide photographic light sensitive emulsion, as taught in U.S. Pat. No. 4,798,780, contains a hydrazine of the general formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an N-substituted or unsubstituted imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

Use of even small amounts of the pepper reducing agents of this invention may cause a reduction in pepper appearing on the developed image. However, the amount of pepper reducing agent is preferably at least 0.003 moles/mole Ag, and more preferably at least 0.004 moles/moles Ag. The maximum amount of pepper reducing agent which may be added is limited by the solubility of the agent in the emulsion and by the need for certain proportions of other active ingredients. According to a preferred embodiment, no more than 0.10 moles of pepper reducing agent/mole Ag should be used. More preferably, no more than 0.05 moles pepper reducing agent/mole Ag should be used.

EXAMPLES

Example 1

The following examples further illustrate this invention.

A silver halide emulsion with a bromide:chloride:iodide ratio of 68:30:2 was prepared by conventional double jet techniques. Conditions were chosen so that an emulsion with a narrow grain size distribution was obtained having an average grain size of 0.2 micron. The emulsion was coagulated and washed in the conventional manner and reconstituted to give a silver ratio of 93 g gelatin per mole of silver. The emulsion was chemically sensitized with sulfur.

The emulsion was coated onto polyester base at a silver coating weight of 4.3 g/m$^2$ with the following additions: wetting agent (Hostapur™), a polyethylene oxide (Brij 58), a sensitizing dye (5-(5-methoxy- 3-(4-sulfobutyl)-2-(3H) benzothiazolylidene)- 4-oxo-3-(2-hydroxyethyl)-2-thioxothiazolidene), a contrast promoting agent (benzhydrol), a hydrazide derivative (1-(2'-hydroxymethylbenzoyl)-2-phenyl hydrazine), ascorbic acid, colloidal silica (Ludox™), a pepper reducing agent, and a hardener (2-hydroxy-b-4,6-dichloro- 1,3,5-triazine). Several formulations were prepared in which the moles of pepper reducing agent per mole Ag were varied.

A topcoat was applied comprising 60 g of gelatin per 1000 g water, wetting agent, matting agent (silica), surfactant (FC170C, 3M), polyethylene (Slip-Ayd™), an acrylic latex (Rhoplex™), and a hardener (2-hydroxy-b-4,6-dichloro-1,3,5-triazine).

The samples in Table 1 were individually exposed in an argon ion laser sensitometer which was attenuated by a 0 to 3 continuous neutral density wedge in contact with the coating. The coatings were developed for 35 seconds at 95° F. in 3M Excelerate™ developer (a hydroquinone developer, pH 11.4, commercially available from 3M).

TABLE 1

| Sample* | Amount M/M Ag. | Dmin | Dmax | Toe Gamma | Mid Gamma | Shoulder Gamma | Rel. Speed | Pepper Count† |
|---|---|---|---|---|---|---|---|---|
| Control | | 0.02 | 4.88 | 3.07 | 15.56 | 5.51 | 0.99 | 10 |
| 1 | 0.0028 | 0.02 | 4.83 | 3.12 | 14.67 | 5.82 | 0.99 | 13 |
| 1 | 0.0055 | 0.02 | 4.84 | 3.14 | 15.22 | 5.55 | 0.99 | 5 |
| 1 | 0.0110 | 0.02 | 4.79 | 3.08 | 14.53 | 5.27 | 0.97 | 3 |
| 1 | 0.0220 | 0.02 | 4.68 | 2.87 | 13.34 | 4.20 | 0.94 | 3 |
| Control | | 0.02 | 4.73 | 2.86 | 13.51 | 4.48 | 0.94 | 16 |
| 2 | 0.0019 | 0.02 | 4.70 | 2.87 | 13.77 | 4.30 | 0.93 | 11 |
| 2 | 0.0038 | 0.02 | 4.72 | 2.95 | 13.93 | 4.36 | 0.95 | 8 |
| 2 | 0.0175 | 0.02 | 4.71 | 2.75 | 13.66 | 4.25 | 0.93 | 8 |
| 2 | 0.0150 | 0.02 | 4.56 | 2.63 | 12.75 | 3.37 | 0.88 | 4 |
| Control | | 0.02 | 4.88 | 3.07 | 15.56 | 5.51 | 0.99 | 10 |
| 3 | 0.0055 | 0.02 | 4.84 | 3.09 | 14.60 | 5.28 | 0.98 | 7 |
| 3 | 0.0111 | 0.02 | 4.78 | 3.04 | 14.49 | 5.25 | 0.97 | 3 |
| 3 | 0.0221 | 0.02 | 4.75 | 3.11 | 14.89 | 5.31 | 0.97 | 6 |
| Control | | 0.03 | 4.83 | 3.13 | 15.31 | 6.39 | 1.03 | 19 |
| 4 | 0.0044 | 0.02 | 4.84 | 3.18 | 14.16 | 6.07 | 1.02 | 10 |
| 4 | 0.0088 | 0.02 | 4.75 | 3.08 | 14.85 | 5.82 | 1.03 | 9 |
| 4 | 0.0176 | 0.03 | 4.72 | 2.99 | 14.53 | 5.37 | 1.00 | 9 |
| Control | | 0.03 | 4.83 | 3.13 | 15.31 | 6.39 | 1.03 | 19 |
| 5 | 0.0021 | 0.03 | 4.87 | 3.08 | 13.87 | 5.39 | 1.02 | 11 |
| 5 | 0.0043 | 0.03 | 4.90 | 2.95 | 13.08 | 5.11 | 1.04 | 5 |
| 5 | 0.0086 | 0.03 | 4.82 | 2.46 | 11.52 | 4.92 | 1.01 | 2 |
| 5 | 0.0171 | 0.03 | 4.98 | 2.30 | 11.07 | 5.60 | 0.96 | 3 |

†The pepper count is the number of black specks (or pepper spots) per 16.5 $mm^2$. The values shown are the average of three readings.
*The compounds used in the Samples are as follows:
Compound 1 is 2,5 piperazinedione.
Compound 2 is 2,3-pyrazinedicarboxamide.
Compound 3 is glutarimide.
Compound 4 is glycol uril.
Compound 5 is 3-iminoisoindolinone.

Example 2

The samples shown in Table 2 were prepared and imaged as described above with the exception of the inclusion of 3-indazolinone in the final at 1.25 g/mole of silver. Use of 3-indazolinone and its effect on pepper and contrast are discussed in Applicant's copending application entitled "Contrast-Promoting Agents In Graphic Arts Media", bearing Attorney Docket No. 50425USA4A, which was filed on the same date as this application.

TABLE 2

| Sample* | Amount M/M Ag | Dmin | Dmax | Toe Gamma | Mid Gamma | Shoulder Gamma | Rel. Speed | Pepper Count† |
|---|---|---|---|---|---|---|---|---|
| Control | | 0.03 | 5.17 | 3.23 | 18.39 | 11.76 | 1.07 | 15 |
| 1 | 0.0440 | 0.03 | 5.18 | 3.14 | 17.14 | 10.33 | 1.05 | 10 |
| Control | | 0.03 | 5.18 | 3.13 | 16.92 | 11.04 | 1.11 | 38 |
| 2 | 0.0301 | 0.03 | 5.18 | 3.17 | 16.84 | 9.97 | 1.08 | 22 |
| Control | | 0.03 | 5.17 | 3.23 | 18.39 | 11.76 | 1.07 | 15 |
| 3 | 0.0111 | 0.03 | 5.20 | 3.17 | 17.60 | 11.11 | 1.05 | 11 |

†The pepper count is the number of black specks (or pepper spots) per 16.5 $mm^2$. The values shown are the average of three readings.
*The compounds used in the Samples are as follows:
Compound 1 is 2,5 piperazinedione.
Compound 2 is 2,3-pyrazinedicarboxamide.
Compound 3 is glutarimide.

Example 3

The following compounds, some of which are known in the photographic art as having beneficial properties for silver halide emulsions, were evaluated in the same manner as the previous examples but were found not to be effective as pepper reducing agents: 1,2-diacetylhydrazine; napthol; 1,8-naphthalimide; 1-phenyl-3-(2-thiazolyl)-2-thiourea; 1,4,8,11-tetraazacyclotetradecane-5,7-dione; 3a, 4,5,6-tetrahydro-succinimido[3,4-b]acenaphthen- 10-one; 4,4'-trimethylenebis(1-piperidinecarboxamide); benzoyleneurea {alternate name: 2,4(1H, 3H)-quinazolindeione}; 1,5-dihydropyrimido(5,4-d)pyrimidine-2,4,6,8(3 H,7H)-tetrone; isatoic anhydride; phthalhydrazide {alternate name: 2,3-dihydro- 1,4-phthalazinedione}; 2H-pyrido[3,2-b)- 1,4-oxazin-3(4H)-one; barbituric acid; melamine cyanurate; cytosine; 4-5-dihydro-6-methyl-3(2H)-pyridazinone monohydrate; 2,4-dioxohexahydro-1,3,5-triazine; isonicotinamide; methyl-3-pyridylcarbamate; 1-methyluracil; 5-methyl-2-thiouracil; nicotinamide; orotic acid monohydrate {alternate name: 2,6-dioxo- 1,2,3,6-tetrahydro-4-pyrimidinecarboxylic acid}; uracil {alternate name: 2,4(1H,3H)-pyrimidinedione}; valerolactam {alternate name: 2-piperidone}; 7,9-dioxo-8-azaspiro(4,5)-decane- 6,10-dicarbonitrile; 5-ethyl-5-p-tolylbarbituric acid; 1-(carboxymethyl)pyridinium chloride hydrazide; 1-(3-pyridylmethyl)urea; creatinine; hydantoin; 2-imidazolidone; 2,5-oxazolidinedione; 2-thiohydantoin; 2-thiophenecarboxamide; parabanic acid; (4S, 5R)-(+)-1,5-dimethyl-4-phenyl- 2-imidazolidinone; ethyl-2-(formylamino)-4-thiazoleacetate; DL-5-(4-hydroxphenyl)-5-phenylhydantoin; (S)-(+)-4-phenyl-2-oxazolidinone; 1-phenyl- 3-pyrazolidone; 1-ethyl-2-benzimidazolinone; 5-fluoroisatin; phthalimide; pyromelitic diimide; saccharin {alternate name: o-benzoic sulfimide}; 6-thioxanthine {alternate name: 2-hydroxy- 6-mercaptopurine}; xanthine.

The fact that so many photographically useful compounds and other compounds were found to have little or no effect on pepper fog is an indication of the uniqueness of the compounds of the present invention.

What is claimed is:

1. A silver halide photographic film comprising a substrate and a photographic emulsion coated on the substrate, wherein the emulsion comprises a hydrazine, silver halide grains, and a pepper reducing agent selected from the group consisting of: 2,5-piperizinediones; glycol urils; 3-iminoisoindolinones; or glutarimides, wherein said photographic film is a black and white photographic film.

2. The photographic element of claim 1 wherein said pepper reducing agent is represented by the formula:

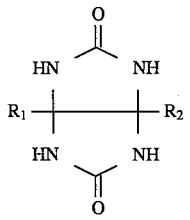

wherein $R_1$ and $R_2$ are independently hydrogen, alkyl, alkanol, carboxy alkyl, or alkyl sulfonic acid groups.

3. The photographic element of claim 1 wherein said pepper reducing agent is represented by the formula:

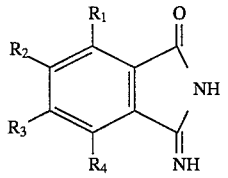

wherein, $R_1$, $R_2$, $R_3$, and $R_4$ independently are hydrogen, alkyl or cyclic alkyl groups or any pair of $R_1$ and $R_2$, $R_2$ and $R_3$, or $R_3$ and $R_4$ taken together form an aromatic ring.

4. The photographic element of claim 1 wherein said pepper reducing agent is represented by the formula:

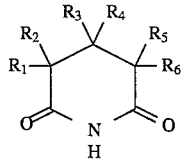

wherein, $R_1$, $R_2$, $R_3$, $R_4$, $R_5$, and $R_6$ are independently hydrogen, alkyl, alkanol, carboxy alkyl, or alkyl sulfonic acid groups.

5. The photographic element of claim 1 wherein said pepper reducing agent is represented by the formula:

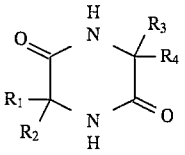

wherein $R_1$, $R_2$, $R_3$, and $R_4$ are independently hydrogen, alkyl, alkanol, carboxy alkyl or alkyl sulfonic acid groups.

6. The photographic element of claim 1 in which the hydrazine is represented by the formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an N-substituted or unsubstituted imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

7. A silver halide photographic film comprising a substrate and a photographic emulsion coated on the substrate, wherein the emulsion comprises a hydrazine, silver halide grains, and a pepper reducing agent which is present in amounts 0.003 to 0.015 moles per mole of silver, and is represented by the formula:

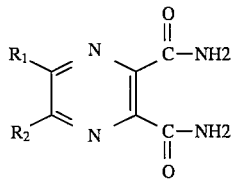

wherein, $R_1$ and $R_2$ independently are hydrogen, alkyl or cyclic alkyl groups or $R_1$ and $R_2$ taken together form an aromatic ring.

8. A photographic emulsion comprising a hydrophilic colloid binder, negative-acting silver halide grains, a hydrazine, and a pepper reducing agent selected from the group consisting of: 2,5-piperizinediones; glycol urils; 3-iminoisoindolinones; or glutarimides, wherein said photograhpic emulsion is a black and white photographic emulsion.

9. The photographic emulsion of claim 8 wherein the pepper reducing agent is represented by the formula:

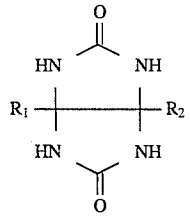

wherein $R_1$ and $R_2$ are independently hydrogen, alkyl, alkanol, carboxy alkyl, or alkyl sulfonic acid groups.

10. The photographic emulsion of claim 8 wherein said pepper reducing agent is represented by the formula:

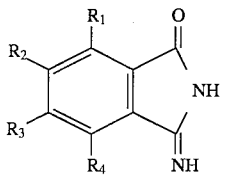

wherein, $R_1$, $R_2$, $R_3$, and $R_4$ independently are hydrogen, alkyl or cyclic alkyl groups or any pair of $R_1$ and $R_2$, $R_2$ and $R_3$, or $R_3$ and $R_4$ taken together form an aromatic ring.

11. The photographic emulsion of claim 8 wherein said pepper reducing agent is represented by the formula:

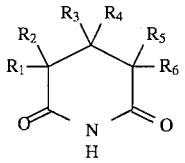

wherein, $R_1$, $R_2$, $R_3$, $R_4$, $R_5$, and $R_6$ are independently hydrogen, alkyl, alkanol, carboxy alkyl, or alkyl sulfonic acid groups.

12. The photographic emulsion of claim 8 wherein said pepper reducing agent is represented by the formula:

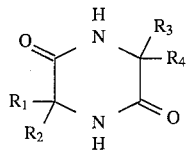

wherein $R_1$, $R_2$, $R_3$, and $R_4$ are independently hydrogen, alkyl, alkanol, carboxy alkyl or alkyl sulfonic acid groups.

13. A photographic emulsion comprising a hydrophilic colloid binder, negative-acting silver halide grains, a hydrazine, and a pepper reducing agent wherein said pepper reducing agent is present in amounts from 0.003 to 0.015 moles per mole Ag and is represented by the formula:

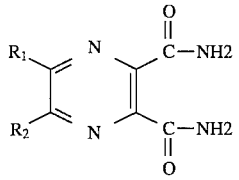

wherein, $R_1$ and $R_2$ independently are hydrogen, alkyl or cyclic alkyl groups or $R_1$ and $R_2$ taken together form an aromatic ring.

* * * * *

UNITED STATES PATENT AND TRADEMARK OFFICE

CERTIFICATE OF CORRECTION

PATENT NO. : 5,494,776

DATED : February 27, 1996

INVENTOR(S) : Cotner

It is certified that error appears in the above-indentified patent and that said Letters Patent is hereby corrected as shown below:

Title page item [56], U.S. PATENT DOCUMENTS 4,411,987 10/1983 Kobayashi et al. .....430/542
5,232,818 8/1993 Machonkin et al. .....430/264

Col. 10, lines 50/51, "photograhpic" should be --photographic--.

Signed and Sealed this

Seventeenth Day of September, 1996

*Attest:*

Bruce Lehman

BRUCE LEHMAN

*Attesting Officer*

*Commissioner of Patents and Trademarks*